US011311768B2

(12) United States Patent
Mora et al.

(10) Patent No.: US 11,311,768 B2
(45) Date of Patent: Apr. 26, 2022

(54) JOINT EXTENSION METHOD AND EXERCISE SYSTEM

(71) Applicants: Carlos Dennis Mora, Albuquerque, NM (US); Dirk Alan Frew, Tijeras, NM (US)

(72) Inventors: Carlos Dennis Mora, Albuquerque, NM (US); Dirk Alan Frew, Tijeras, NM (US)

( * ) Notice: Subject to any disclaimer, the term of this patent is extended or adjusted under 35 U.S.C. 154(b) by 16 days.

(21) Appl. No.: 16/947,610

(22) Filed: Aug. 10, 2020

(65) Prior Publication Data

US 2021/0236872 A1 Aug. 5, 2021

Related U.S. Application Data

(60) Provisional application No. 62/978,533, filed on Feb. 19, 2020, provisional application No. 62/968,367, filed on Jan. 31, 2020.

(51) Int. Cl.

| | |
|---|---|
| ***A63B 21/04*** | (2006.01) |
| ***A63B 22/00*** | (2006.01) |
| ***A63B 21/00*** | (2006.01) |
| ***A63B 21/055*** | (2006.01) |

(52) U.S. Cl.

CPC ..... *A63B 21/0442* (2013.01); *A63B 21/0552* (2013.01); *A63B 21/4009* (2015.10); *A63B 21/4011* (2015.10); *A63B 21/4019* (2015.10); *A63B 22/0076* (2013.01)

(58) Field of Classification Search

CPC ..... A63B 21/0442; A63B 21/4019; A63B 21/4009; A63B 21/4011; A63B 21/0552; A63B 2022/0079; A63B 22/0087; A63B 21/00181; A63B 2023/0411; A63B 22/205; A63B 21/4023; A63B 21/4033; A63B 21/0414; A63B 22/0076–0089; A63B 21/02; A63B 21/04; A63B 21/0407; A63B 21/0421; A63B 21/0428; A63B 21/0435; A63B 21/05–0557; A63B 2208/00–14

See application file for complete search history.

(56) References Cited

U.S. PATENT DOCUMENTS

| | | | | | |
|---|---|---|---|---|---|
| 3,659,846 | A * | 5/1972 | Kanicki | A63B 23/0494 | 482/129 |
| 4,542,900 | A | 9/1985 | Ray | | |
| 5,295,931 | A * | 3/1994 | Dreibelbis | A63B 21/1609 | 482/125 |
| 5,312,315 | A | 5/1994 | Mortensen et al. | | |
| 5,333,604 | A | 8/1994 | Green et al. | | |
| 5,509,894 | A | 4/1996 | Mason et al. | | |
| 5,820,528 | A * | 10/1998 | McAndrew | A63B 22/0076 | 482/121 |
| 5,980,435 | A | 11/1999 | Joutras et al. | | |
| 6,132,346 | A | 10/2000 | Weeks | | |
| 6,456,885 | B1 | 9/2002 | Shiba et al. | | |
| 6,595,904 | B1 | 7/2003 | Staffa | | |
| 6,605,024 | B2 | 8/2003 | Stearns | | |
| 6,676,577 | B2 | 1/2004 | Stearns | | |

(Continued)

*Primary Examiner* — Joshua Lee
*Assistant Examiner* — Catrina A Letterman
(74) *Attorney, Agent, or Firm* — Dunlap Bennett & Ludwig, PLLC

(57) ABSTRACT

A joint extension system that embodies a method of exercise that applies progressive accommodating resistance to joint extension during closed-chain movement.

8 Claims, 4 Drawing Sheets

(56) References Cited

U.S. PATENT DOCUMENTS

| | | | | |
|---|---|---|---|---|
| 7,270,630 | B1 * | 9/2007 | Patterson | A63B 21/4017 482/121 |
| 7,785,232 | B2 | 8/2010 | Cole et al. | |
| 7,828,700 | B1 * | 11/2010 | Tsai | A63B 21/4047 482/121 |
| 8,007,414 | B2 | 8/2011 | Riney et al. | |
| 8,597,165 | B1 | 12/2013 | Antonucci | |
| 9,295,871 | B2 | 3/2016 | Luedeka | |
| 9,474,675 | B2 | 10/2016 | Hansen | |
| 9,662,526 | B2 | 5/2017 | Agrawal et al. | |
| 9,821,184 | B1 * | 11/2017 | Chapman | A63B 21/0557 |
| 11,071,886 | B1 * | 7/2021 | Scholten | A63B 21/4031 |
| 2006/0199706 | A1 * | 9/2006 | Wehrell | A63B 21/4019 482/92 |
| 2008/0081745 | A1 | 4/2008 | Sargen et al. | |
| 2010/0130336 | A1 * | 5/2010 | McSorley | A63B 23/0355 482/110 |
| 2014/0087928 | A1 * | 3/2014 | Luedeka | A63B 21/0552 482/130 |
| 2014/0094721 | A1 | 4/2014 | Diallo | |
| 2014/0194260 | A1 | 7/2014 | Campanaro et al. | |
| 2015/0231469 | A1 * | 8/2015 | Pretz | A63B 69/0002 473/458 |
| 2017/0182349 | A1 * | 6/2017 | DiMartino | A63B 21/4007 |
| 2018/0178058 | A1 * | 6/2018 | Fano | A63B 21/00065 |
| 2018/0214729 | A1 * | 8/2018 | Rubin | A63B 21/0058 |
| 2018/0290002 | A1 * | 10/2018 | Colangelo | A63B 21/00043 |
| 2020/0289874 | A1 * | 9/2020 | Sanders | A63B 21/0414 |
| 2021/0283458 | A1 * | 9/2021 | Parker | A63B 21/00069 |
| 2021/0394006 | A1 * | 12/2021 | Norris | A63B 22/0076 |

* cited by examiner

JOINT EXTENSION METHOD AND EXERCISE SYSTEM

CROSS-REFERENCE TO RELATED APPLICATION

This application claims the benefit of priority of U.S. provisional application No. 62/968,367, filed Jan. 31, 2020, and U.S. provisional application No. 62/978,533, filed Feb. 19, 2020, the contents of which are herein incorporated by reference.

BACKGROUND OF THE INVENTION

The present invention relates to exercising and, more particularly, to a joint extension method and exercise device.

Full range of motion for your joints become an issue when you are dealing with pain or muscular weaknesses. If pain persists or musculature is not strengthened to increase full range of motion, joint injury may occur.

Other methods of exercise lack tapering resistance levels throughout movement, placing more impact on a user's joints for longer periods of time. Other methods also tend to place resistance directly compressed onto the spine, leading to susceptibility of injury if a user has poor exercise form.

Other methods do not maximize resistance levels at the full range of a movement, therefore provide fixed or minimally deviating levels of resistance. This does not allow the exercise user to maximize muscular contraction at the concentric end-phase of a movement, having that the resistance level is constant throughout the start of the exercise.

As can be seen, there is a need for a joint extension method and exercise device.

SUMMARY OF THE INVENTION

In one aspect of the present invention, a method for joint extension method exercise includes the following: securing a fixed component; securing a kinetic component to a user and attaching progressive accommodating resistance between the fixed component and the kinetic component in such a way that the user experiences deviating resistance during joint extension and flexion, wherein during joint extension and flexion the kinetic component moves relative to the fixed component, wherein the joint extension and flexion defines a closed-chain movement comprising a concentric phase wherein the kinetic component moves away from the fixed component and an eccentric phase wherein the kinetic component moves toward the fixed component, wherein the kinetic component experiences a tensile decrease during the eccentric phase, wherein the kinetic component engages a sagittal portion of the user, wherein the fixed component is anterior to the user, wherein the kinetic component engages adjacent to and below a knee of the user; further including the securing of at least one second kinetic component to one or more hands of the user, wherein the user is exercising in a rowing machine.

In another aspect of the present invention, a method of adapting any exercise or therapeutic routine that requires a joint extension and flexion element so that resistance is not directly compressed on the spine of a user includes providing the above-mentioned method in such a way that to facilitate the joint extension and flexion element.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a joint extension method and system that embodies a method of exercise that applies progressive accommodating resistance to joint extension during closed-chain movement. The present invention helps restore mobility and strength to joints and extremities through progressive accommodating resistance during joint extension and flexion. Progressive accommodating resistance through partial and full range of motion of muscles extending during closed-chain exercise helps strengthen the joints and supporting muscles and decreases the risk of pain and injury.

The present invention has progressive accommodating resistance, which deviates resistance levels progressively throughout the full-range of motion of an exercise without significantly compressing the spine. Other methods rely on resistance types that have minimal to no variability during movement, placing significant compression on the spine throughout exercise. The present invention allows a user to progressively magnify muscular activation and vary resistance levels during full-range movement of a closed-chain exercise. The progressive accommodating resistance of the present invention provides low impact to joints with minimal spinal compression and provides maximal muscular contraction at the concentric end-phase of movement. The present invention may also serve as an adapter to existing apparatuses that require joint extension during movement but do not provide progressive accommodating resistance.

Figure 1A:
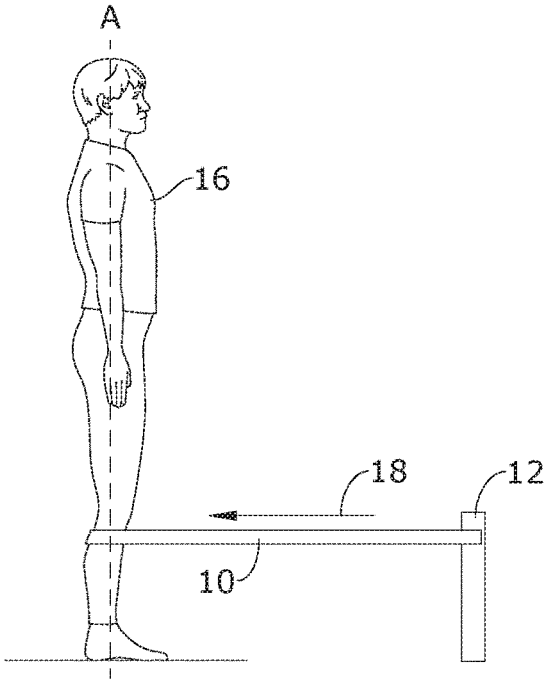
FIG. 1A is a side view of an exemplary embodiment of the present invention, showing a user squatting with resistance increasing.
Figure 1B:
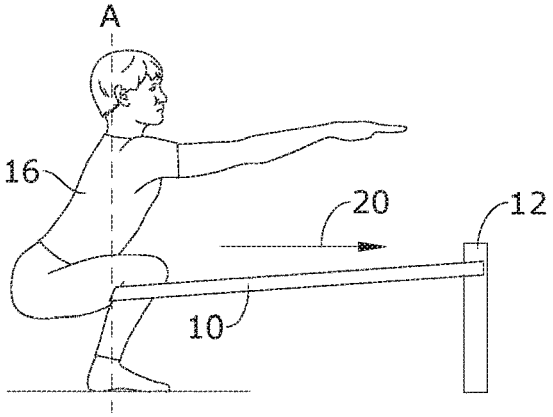
FIG. 1B is a side view of an exemplary embodiment of the present invention, showing a user squatting with resistance decreasing.
Figure 2A:
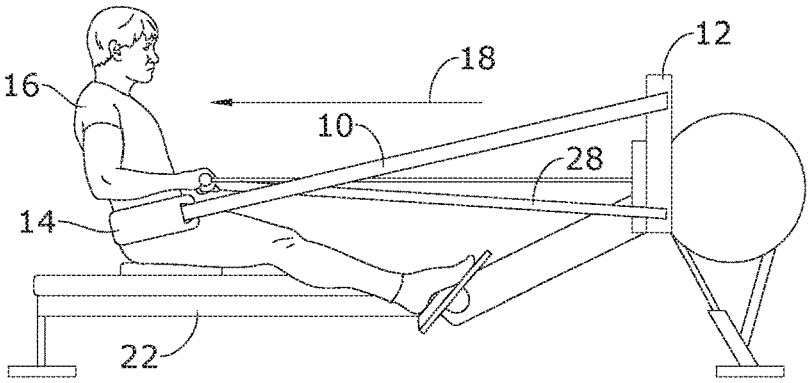
FIG. 2A is a side view of an exemplary embodiment of the present invention, showing a user rowing with resistance increasing.
Figure 2B:
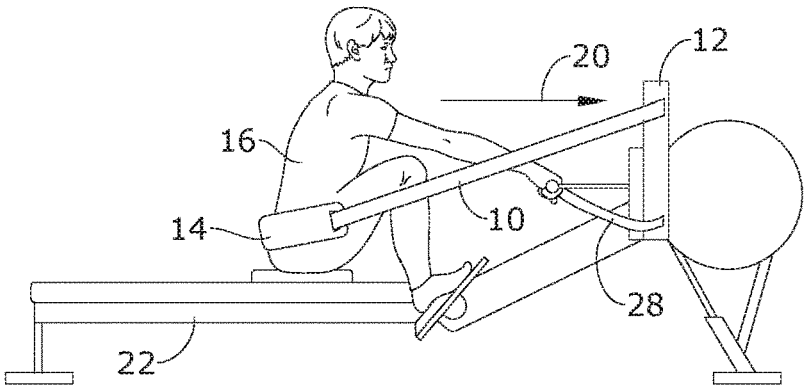
FIG. 2B is a side view of an exemplary embodiment of the present invention, showing a user rowing with resistance decreasing.
Figure 3A:
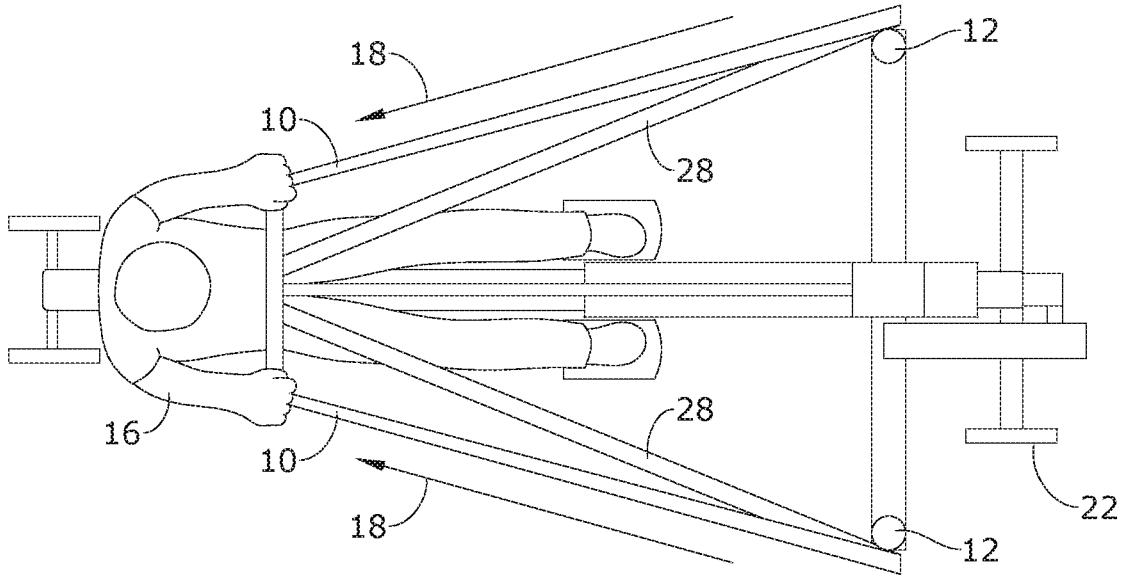
FIG. 3A is a top plan view of an exemplary embodiment of the present invention, showing a user rowing with resistance increasing.
Figure 3B:
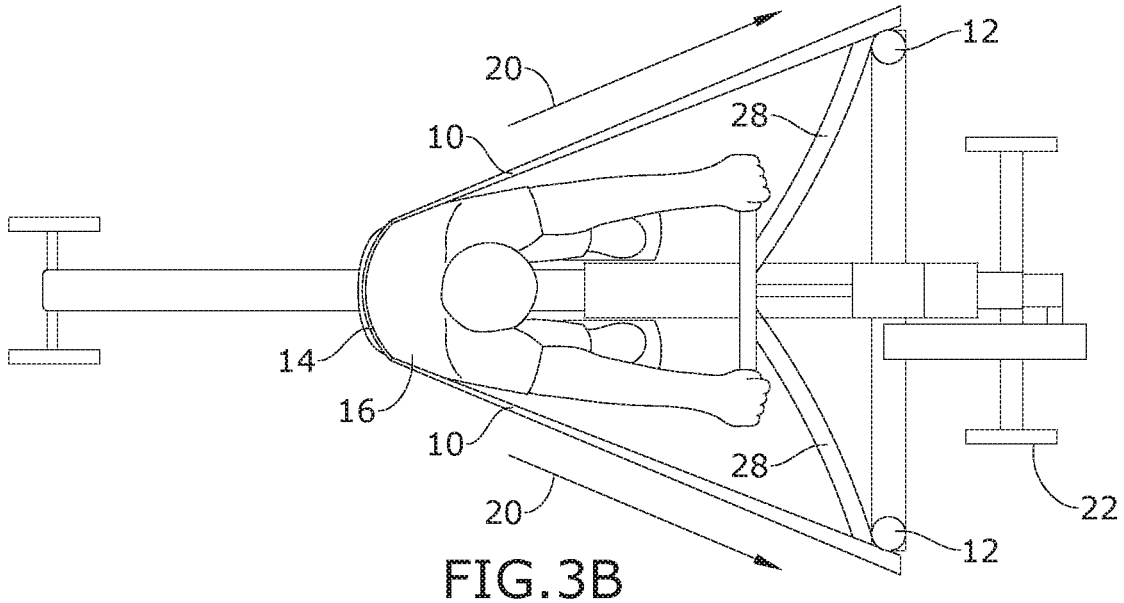
FIG. 3B is a top plan view of an exemplary embodiment of the present invention, showing a user rowing with resistance decreasing.
Figure 4A:
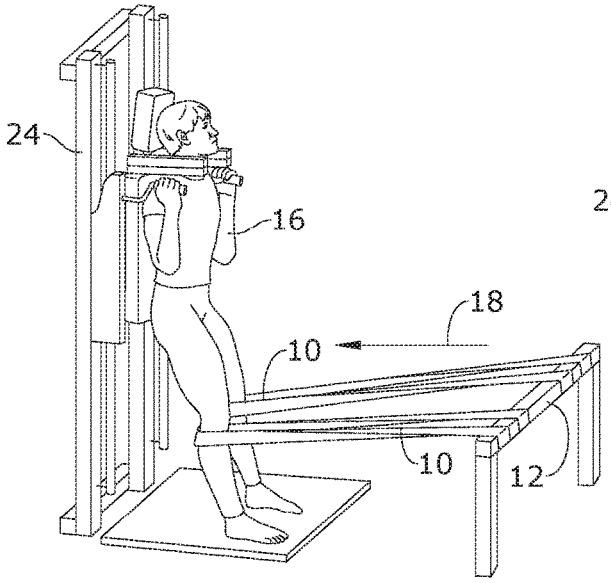
FIG. 4A is a perspective view of an exemplary embodiment of the present invention, showing a user hack squatting with resistance increasing.
Figure 4B:
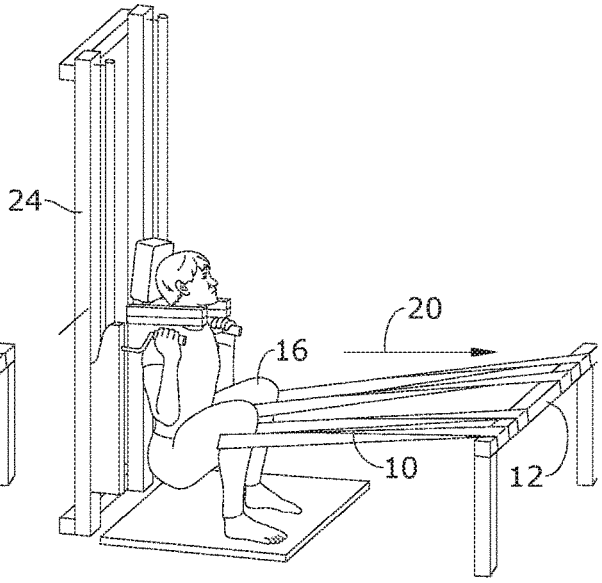
FIG. 4B is a perspective view of an exemplary embodiment of the present invention, showing a user hack squatting with resistance decreasing.
Figure 5A:
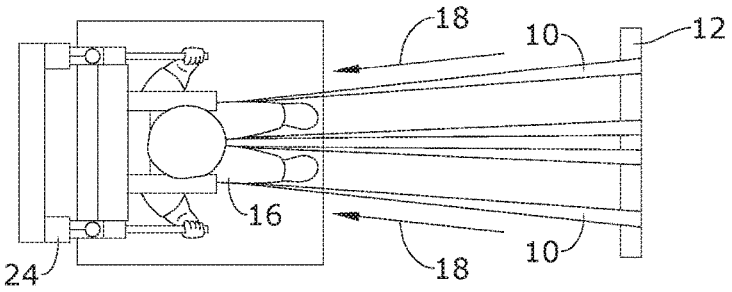
FIG. 5A is a top plan view of an exemplary embodiment of the present invention, showing a user hack squatting with resistance increasing.
Figure 5B:
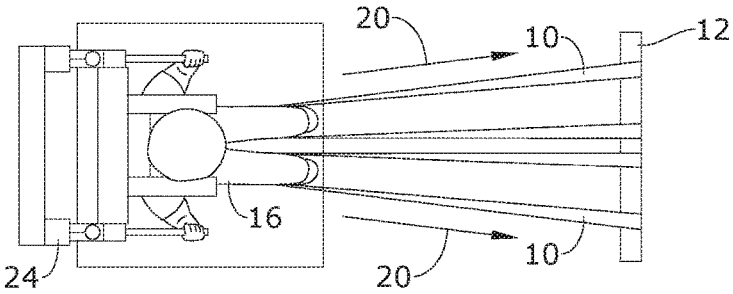
FIG. 5B is a top plan view of an exemplary embodiment of the present invention, showing a user hack squatting with resistance decreasing.

FIGS. 1A and 1B illustrate a user 16 performing a squatting exercise of the present invention. Tension bands 10 are wrapped around the user's legs just below the knee and attached to an anterior mount apparatus 12. As the user 16 performs a squat, the progressive accommodating resistance of the tension bands 10 experiences a tensile increase 18 as the user 16 raises and the progressive accommodating resistance of the tension bands 10 experiences a tensile decrease 20 as the user 16 squats downward. This is a result, in part, of the shift in the distal end or posterior mount apparatus 14 of the tension band 10 relative to the anterior mount apparatus 12. To wit, FIGS. 1A and 1B showing said distal end/posterior mount apparatus 14 further from the anterior mount apparatus 12 in the former and nearer to the anterior mount apparatus 12 in the latter (relative to the axis "A" or coronal or frontal plane of the user 16). The tensile increase 18 is associated with a direction pointed away from the anterior mount apparatus 12, while the tensile decrease 20 is associated with a direction pointed toward the anterior mount apparatus 12.

FIGS. 2A, 2B and 3A, 3B illustrate a user 16 performing a rowing exercise of the present invention using a rowing machine 22. Tension band(s) 10 are wrapped around the user's lower extremity and attached to the anterior mount apparatus 12 affixed to a rowing machine. As the user 16 pushes backwards, the progressive accommodating resistance of the tension band(s) 10 experiences the tensile increase 18 and the progressive accommodating resistance of the tension band(s) 10 experiences a tensile decrease 20 as the user 16 bends forward.

FIGS. 4A, 4B and 5A, 5B illustrate a user 16 performing a hack squatting exercise of the present invention using a lifting machine 24. Tension bands 10 are wrapped around the user's lower extremity just below the knee and attached to an anterior mount apparatus 12. As the user 16 performs a lifting-squat ("hack squat"), the progressive accommodating resistance of the tension bands 10 experience a tensile increase 18 as the user 16 raises and the progressive accommodating resistance of the tension bands 10 experiences a tensile decrease 20 as the user 16 squats downward. In certain embodiments, the present invention may include an optional resistance band 28 mounted to two spaced apart anterior mounting apparatuses 12, defining a triangular configuration wherein the tensile increases and decreases 18 and 20 are transverse to a median plane of the user 16.

Figure 6A:
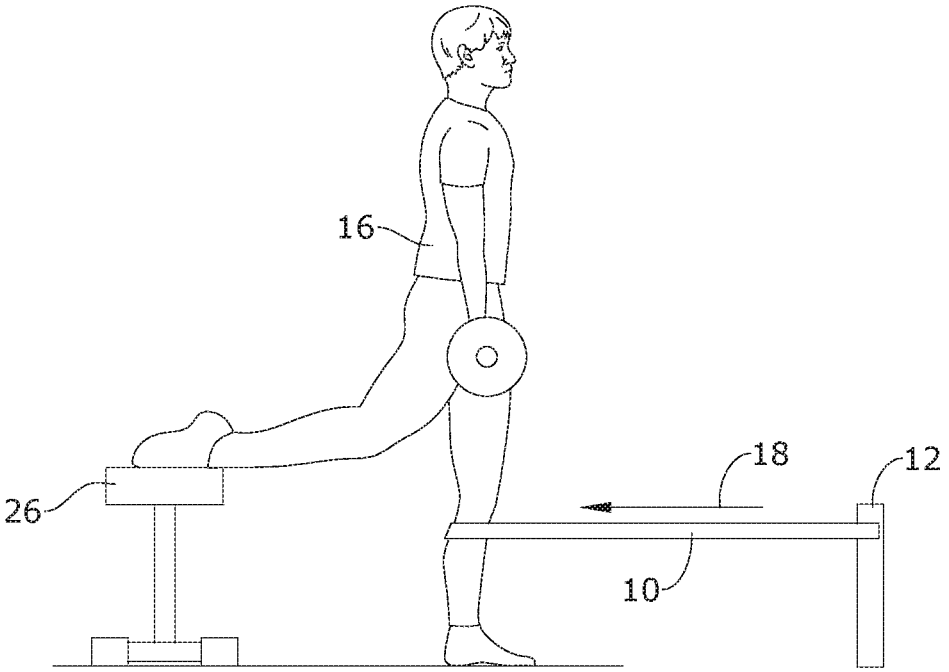
FIG. 6A is a side view of an exemplary embodiment of the present invention, showing a user split-squatting with resistance increasing.
Figure 6B:
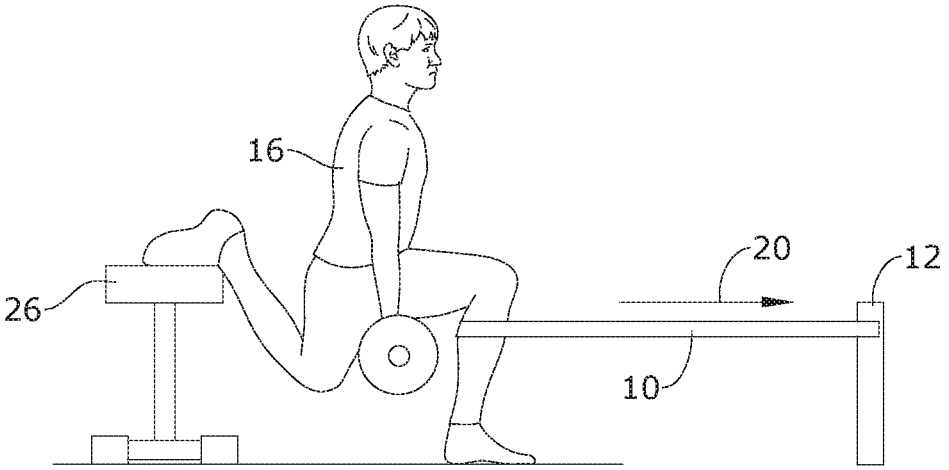
FIG. 6B is a side view of an exemplary embodiment of the present invention, showing a user split-squatting with resistance decreasing.

FIGS. 6A and 6B illustrates a user 16 split squatting utilizing the present invention with a bench 26. The bench 26 facilitates using one tension band 10 wrapped around a single leg of a user 16 just below the knee and attached to an anterior mount apparatus 12, wherein the other leg engages the bench 26. The progressive accommodating resistance of the tension bands 10 experiences a tensile increase 18 as the user 16 raises and the progressive accommodating resistance of the tension bands 10 experiences a tensile decrease 20 as the user 16 squats downward. In certain embodiments, the present invention may include an alternative to the bench 26, wherein the user's other leg engages said alternative to perform the split squatting exercise.

The present invention embodies a user performing an exercise that requires joint extension, with progressive accommodating resistance applied to the joint extension of a user's movement. Resistance levels are directly related to the distance between the fixed anterior mount apparatus 12 in front of the user and kinetic posterior mount apparatus 14 placed onto the user's posterior frontal plane lower extremity.

This allows the user to have deviating resistance throughout movement, with resistance being at a maximum during the end-range of concentric motion and at a minimum during the end-range of eccentric motion. The kinetic posterior mount apparatus 14 may be at its furthest from the anterior mount apparatus 12 when resistance is at its highest, and the posterior mount apparatus 14 is at its closest to the anterior mount apparatus 12 when resistance it at its lowest. In addition to the anterior and posterior mounts 12 and 14, a third optional kinetic hand mount (not shown) placed into the user's hands also provides progressive accommodating resistance to joint extension in relation to its distance from the fixed anterior mount apparatus 12 during the user's exercise movement that requires joint extension of the upper body.

The present invention allows a user to perform a closed-chain exercise movement with progressive accommodating resistance applied to joint extension. This is accomplished by a minimum of two components: The anterior mount apparatus 12 and posterior mount apparatus 14, working together to apply resistance in relation to a user's exercise movement. The anterior mount apparatus 12 may be a fixed apparatus that has two mounting points in which progressive accommodating resistance is placed on.

The exercise user attaches progressive accommodating resistance to these two mounting points, while facing the anterior mount apparatus 12 and equidistantly aligning the sagittal planes of their body to this component's two mounting points respectively. Next the exercise user attaches the unmounted ends of resistance held on each mounting point of the anterior mount apparatus 12 to each mounting point of the posterior mount apparatus 14.

The posterior mount apparatus 14 is a kinetic mounting mechanism placed on a user's posterior frontal plane lower extremity that moves in unison with a user's body movement to apply progressive accommodating resistance to joint extension. Though only FIGS. 2A, 2B and 3A, 3B show reference number 14 to the posterior mount apparatus 14, it is understood that the distal end of the tension bands 10 may be the posterior mount apparatus 14 in certain embodiments.

The exercise user now positions the posterior mount apparatus 14 onto the desired sagittal points of their posterior frontal plane lower extremity while facing the anterior mount apparatus 12 and centering their body, to maximize comfort and efficiency of joint extension resistance. The user can now perform the exercise movement, with progressive accommodating resistance applied between the anterior mount apparatus 12, posterior mount apparatus 14 and user's body movement.

As the user 16 performs the concentric portion of exercise movement, the posterior mount apparatus 14 moves further away from the anterior mount apparatus 12. This increases muscular contraction, maximizing resistance once the end-range of concentric joint extension is reached. The user completes full-range of exercise motion once the eccentric portion of movement reaches its end-range, bringing the posterior mount apparatus 14 closer to the anterior mount apparatus 12. Once at the end-range of eccentric exercise movement, resistance is at a minimum between the posterior mount apparatus 14, anterior mount apparatus 12 and the user's body movement. To cease progressive accommodating resistance application to joint extension of the exercise movement, the user detaches the posterior mount apparatus 14 from the sagittal points of their lower extremity.

An optional element to providing progressive accommodating resistance to joint extension for closed-chain exercise is having a posterior mounting apparatus to place resistance onto, affixed to the user's posterior frontal plane lower extremity. This is an optional element having that progressive accommodating resistance can be attached directly onto a user's lower extremity and the anterior mounting source, although this mechanism for mounting may not be as biomechanically comfortable as an apparatus itself being attached to a user's lower extremity (hence the posterior mount apparatus 14 has a mounting mechanism, in certain embodiments and may not be technically an apparatus, but rather the mounting mechanism or even just the distal end of the tension band 10).

Another optional element to providing progressive accommodating resistance during joint extension is having a third kinetic resistance mounting mechanism specifically but not limited to indoor rowers. This mounting mechanism is anterior to the user and affixed to the user's indoor rower handle. This is an optional element having that progressive accommodating resistance can be attached directly onto a user's hands and the anterior mounting source, although this mechanism for mounting may not be as biomechanically comfortable as an apparatus or resistance itself being attached to the indoor rower handle (hence the third optional kinetic mounting source for indoor rowers being a mounting mechanism, not apparatus).

Closed-chain exercise apparatuses that include joint extension during their specific exercise movement are elements that can improve the function of the present invention, having that this exercise method can be applied to a wide range of exercise movements that require joint extension. Closed-chain apparatuses that include joint extension include indoor rowers, leg press machines, hack squat machines, squat/lunge machines and barbell squat racks.

A user would utilize the present invention to help restore mobility and strength in their joints and surrounding muscle groups, through application of progressive accommodating resistance attached to a minimum of two resistance mounting components.

One anterior mounting apparatus in front of the user, and one posterior mounting mechanism attached to the user's posterior frontal plane lower extremity to achieve progressive accommodating resistance during joint extension. This is achieved by applying the present invention to a variety of closed-chain movements that use partial to full range of motion of joint extension such as indoor rowing, leg press machines and squatting exercises. A user would utilize the present invention by first choosing a level of progressive accommodating resistance, next attaching the resistance to the two mounting sources, positioning the posterior mounting mechanism onto their lower extremity while facing the anterior mounting apparatus, and lastly performing the chosen exercise movement with full range of motion at the concentric phase of exercise to apply maximal progressive accommodating resistance to joint extension.

A user may create an anterior mounting apparatus in relation to where the user is facing, in which progressive accommodating resistance is attached to at two mounting points. A user may also create a posterior mounting mechanism specifically placed on the user's posterior frontal plane lower extremity, with two mounting points that attach to the opposing ends of resistance attached to the two mounting points of the anterior mounting apparatus respectively.

Optionally, a user may create another kinetic mounting mechanism within the user's hands with mounting point(s) attaching to the opposing ends of resistance attached to the two mounting points of the fixed anterior mounting apparatus respectively. This provides the desired effect of deviation in resistance levels for joint extension relative to the distance between the fixed anterior mount to the kinetic posterior and optional kinetic hand mounts during full-range of motion of the closed-chain exercise movement.

The present invention can produce the following (having a minimum of two resistance mounting sources for closed-chain exercise movement):

- A terminal knee extension hack squat device that allows the user to perform a hack squat motion with additional progressive accommodating resistance provided to terminal knee extension and flexion at full-range of motion.
- A terminal knee extension leg press device that allows the user to perform a leg press with additional progressive accommodating resistance provided to terminal knee extension and flexion at full-range of motion.
- A terminal knee extension squat/lunge device that allows the user to perform machine squats and machine lunges with additional progressive accommodating resistance provided to terminal knee extension and flexion at full-range of motion.
- A terminal knee and thoracic extension indoor rower device that allows the user to perform ergometer rowing with additional progressive accommodating resistance provided to terminal knee and thoracic extension and flexion at full-range of motion.
- A terminal knee extension adapter that mounts onto hack squat machines, allowing the user to perform a hack squat with additional progressive accommodating resistance applied to the closed-chain movement.
- A terminal knee extension adapter that mounts onto leg press machines, allowing the user to perform a leg press with additional progressive accommodating resistance applied to the closed-chain movement.
- A terminal knee extension adapter that mounts onto squat/lunge machines, allowing the user to perform a machine squat or machine lunge with additional progressive accommodating resistance applied to the closed-chain movement.
- A terminal knee and thoracic extension adapter that mounts onto indoor rowers, allowing the user to apply progressive accommodating resistance to the closed-chain movement of ergometers.

It should be understood, of course, that the foregoing relates to exemplary embodiments of the invention and that modifications may be made without departing from the spirit and scope of the invention as set forth in the following claims.

What is claimed is:

1. A method for strengthening a plurality of muscles supporting a joint through providing deviating resistance throughout a concentric motion, comprising:

providing a rowing machine with a handle, the rowing machine having a kinetic rowing seat configured to slide on a track between an anterior position and a posterior position;

connecting a first tension portion between the handle and a first fixed point;

connecting a second tension portion between the handle and a second fixed point, wherein the first and second fixed points are located forward of the anterior position and spaced apart along a shared plane a distance greater than a length of the handle;

engaging a kinetic component to a user seated on the kinetic rowing seat, wherein opposing ends of the kinetic component engage the first and second fixed points, and wherein the kinetic component engages the user adjacent to and abaft the kinetic rowing seat; and kinetically moving the rowing seat and the handle in unison through the concentric motion in such a way that the user experiences deviating resistance during joint extension and flexion of the joint.

2. The method of claim 1, wherein during joint extension and flexion the kinetic component and the handle move relative to the first and second fixed points.

3. The method of claim 2, wherein the joint extension and flexion defines a closed-chain movement comprising a concentric phase wherein the kinetic component and the handle move away from the first and second fixed points and an eccentric phase wherein the kinetic component moves toward the first and second fixed points.

4. The method of claim 3, wherein the kinetic component and the handle experiences a tensile decrease during the eccentric phase.

5. The method of claim 4, wherein the handle is engaged by an upper body of the user.

6. The method of claim 5, wherein the rowing seat engages a lower body of the user.

7. The method of claim 6, wherein the handle and the first and second tension portions define an inner triangular configuration wherein the tensile increases and decreases are transverse relative to a median plane of the user.

8. The method of claim 7, wherein the kinetic component defines an outer triangular configuration wherein tensile increases and decreases are transverse relative to the median plane of the user.

* * * * *